US007918452B2

(12) United States Patent
Fuchi

(10) Patent No.: US 7,918,452 B2
(45) Date of Patent: Apr. 5, 2011

(54) SHEET WIDTH ALIGNING DEVICE, SHEET TRANSPORT DEVICE AND IMAGE FORMING APPARATUS

(75) Inventor: Masami Fuchi, Osaka (JP)

(73) Assignee: Kyocera Mita Corporation (JP)

( * ) Notice: Subject to any disclaimer, the term of this patent is extended or adjusted under 35 U.S.C. 154(b) by 310 days.

(21) Appl. No.: 12/180,601

(22) Filed: Jul. 28, 2008

(65) Prior Publication Data

US 2009/0033026 A1 Feb. 5, 2009

(30) Foreign Application Priority Data

Jul. 31, 2007 (JP) ..... 2007-198736

(51) Int. Cl.
*B65H 9/00* (2006.01)

(52) U.S. Cl. ..... 271/240; 271/171

(58) Field of Classification Search ..... 271/240, 271/171

See application file for complete search history.

(56) References Cited

U.S. PATENT DOCUMENTS 4,657,239 A * 4/1987 Ikesue et al. ..... 271/227
4,874,160 A * 10/1989 Yamamoto ..... 271/227
4,949,134 A * 8/1990 Iwaki et al. ..... 399/402
5,251,889 A * 10/1993 Spencer et al. ..... 271/171
5,533,721 A * 7/1996 Takashimizu ..... 271/109
6,955,350 B2 * 10/2005 Hashiguchi et al. ..... 271/255
7,731,183 B2 * 6/2010 Ohno et al. ..... 271/171
2005/0051947 A1 * 3/2005 Furukawa ..... 271/171
2007/0057429 A1 * 3/2007 Watanabe et al. ..... 271/9.01

FOREIGN PATENT DOCUMENTS

JP 8-152772 6/1996

* cited by examiner

*Primary Examiner* — Stefanos Karmis
*Assistant Examiner* — Howard Sanders
(74) *Attorney, Agent, or Firm* — Gerald E. Hespos; Michael J. Porco

(57) ABSTRACT

A sheet width aligning device includes two width aligning members which respectively contact widthwise ends of a sheet to regulate a widthwise position of the sheet. A first detector detects one widthwise end of the sheet and a second detector detects the other widthwise end of the sheet. A moving mechanism moves the first and second detectors located at initial positions at outer sides of the sheet towards the center of the sheet in the widthwise directions. A determining section determines the positions of the width aligning members based on a detection timing, at which the first detector detected the one widthwise end, and a detection timing, at which the second detector detected the other widthwise end. A driving mechanism drives the width aligning members to move to the positions determined by the determining section.

14 Claims, 6 Drawing Sheets

SHEET WIDTH ALIGNING DEVICE, SHEET TRANSPORT DEVICE AND IMAGE FORMING APPARATUS

BACKGROUND OF THE INVENTION

1. Field of the Invention

The present invention relates to a sheet width aligning device for aligning the width of a sheet as transported, and a sheet transport device provided with the sheet width aligning device and also relates to an image forming apparatus provided with the sheet transport device.

2. Description of the Related Art

In recent years, image forming apparatuses such as copiers capable of duplex printing sheets have been widely used. In such image forming apparatuses, the transport destination of a sheet after being subjected to a fixing process is switched to a discharge tray or a reversing tray according to whether simplex printing or duplex printing is to be performed.

In the case of simplex printing, a switching guide is set to a discharge tray side to discharge a sheet finished with the fixing process to the outside. On the other hand, in the case of duplex printing, the switching guide is set to a reversing tray side to introduce a sheet finished with the fixing process on one side to the reversing tray. Thereafter, the sheet is returned to an image forming unit to have an image transferred to the other side thereof after being reversed upside down. The sheet finished with duplex printing is discharged to the outside via the switching guide set to the discharge tray.

Upon duplex printing, printing positions on one and the other sides of a sheet need to be aligned. Japanese Unexamined Patent Publication No. H08-152772 (published on Jun. 11, 1996) discloses a technique for aligning printing positions on one and the other sides of a sheet by moving a focusing lens in a direction orthogonal to an optical axis according to a displacement amount of the lateral registration of a sheet tray storing sheets and moving first and second jogger fences for performing the width alignment of the sheet based on the size of sheets stored in the sheet tray and a lateral registration adjustment value peculiar to the sheet tray.

In the case of duplex printing, width alignment is performed after printing on one side so that printed positions are not displaced on the one and other sides due to the oblique transportation of a sheet upon printing on the other side. This width alignment is performed by regulating the positions of a sheet in a widthwise direction according to the sheet size by a pair of cursors (corresponding to the first and second jogger fences in Japanese Unexamined Patent Publication No. H08-152772). However, even sheets of the same size may have different widths due to the contraction of sheets caused by a fixing process using a heating roller and a pressure roller, size errors and cutting errors of sheets of the respective sheet manufacturers. In such a case, the position of the sheet cannot be perfectly adjusted when adopting the method of simply moving the above cursors according to the standard size (A4, B5, etc.) of the sheet for width alignment, which has caused pattern misalignment on one and other sides.

According to the image forming apparatus of Japanese Unexamined Patent Publication No. H08-152772, the width alignment is performed based on the sheet size and the lateral registration adjustment value corresponding to each sheet tray, it is not possible to precisely align the width of each sheet when differences in sheet width exist among sheets of the same size, and it is therefore not possible to prevent the misalignment in respective printing positions on one and the other sides.

SUMMARY OF THE INVENTION

An object of the present invention is to provide a sheet width aligning device capable of precisely setting printing positions by precisely aligning the width of a sheet upon image formation and a sheet transport device provided with such a sheet width aligning device, and also to provide an image forming apparatus provided with such a sheet transport device.

In order to accomplish this object, one aspect of the present invention is directed to a sheet width aligning device, comprising a pair of width aligning members which respectively come into contact with widthwise ends of a sheet to regulate a widthwise position of the sheet; a first detector for detecting one widthwise end of the sheet; a second detector for detecting the other widthwise end of the sheet; a moving mechanism for moving the first and second detectors located at initial positions at outer sides of the sheet such that the first and second detectors respectively move from one end side and the other end side toward the center of the sheet in widthwise directions; a determining section for determining the positions of the width aligning members based on a detection timing, at which the first detector detected the one widthwise end, and a detection timing, at which the second detector detected the other widthwise end; and a driving mechanism for driving the width aligning members to move to the positions as determined by the determining section.

Another aspect of the present invention is directed to a sheet width aligning device, comprising a pair of width aligning members which respectively come into contact with widthwise ends of a sheet to regulate a widthwise position of the sheet; a first detector for detecting one widthwise end of the sheet; a second detector for detecting the other widthwise end of the sheet; a moving mechanism for moving the first and second detectors located at initial positions at outer sides of the sheet such that the first and second detectors respectively move from one end side and the other end side toward the center of the sheet in widthwise directions; a calculating section for calculating a difference in detection timing between a detection timing, at which the first detector detected the one widthwise end, and a detection timing, at which the second detector detected the other widthwise end; and a notifying section for performing a specified notifying operation based on a difference in detection timing as calculated by the calculating section.

Still another aspect of the present invention is directed to a sheet transport device, comprising a sheet transport path provided with a sheet width aligning device, for transporting a sheet, wherein the sheet width aligning device has the foregoing structure.

Further another aspect of the present invention is directed to an image forming apparatus, comprising a sheet transport path provided with a sheet width aligning device, for transporting a sheet; and an image forming apparatus main body for forming an image on a sheet transported from the sheet transport path, wherein the sheet width aligning device has the foregoing structure.

DETAILED DESCRIPTION OF THE PREFERRED EMBODIMENTS

Hereinafter, a sheet width aligning device and a sheet transport device according to one embodiment of the present invention are described with reference to the accompanying drawings.

Although the present invention is applied to a copier as an image forming apparatus provided a sheet width aligning device and a sheet transport device in the following embodiment, it is also applicable to an electronic apparatus for duplex printing such as a printer, a facsimile machine or a complex machine provided with these functions besides the copier. Although general print sheets (hereinafter, merely referred to as "sheets") are described as printing media, any other duplex printable media may be used. Further, the copier described in the following embodiment is for printing by fixing a toner image to a sheet, but printing may be performed, for example, by an ink-jet method.

Figure 1:
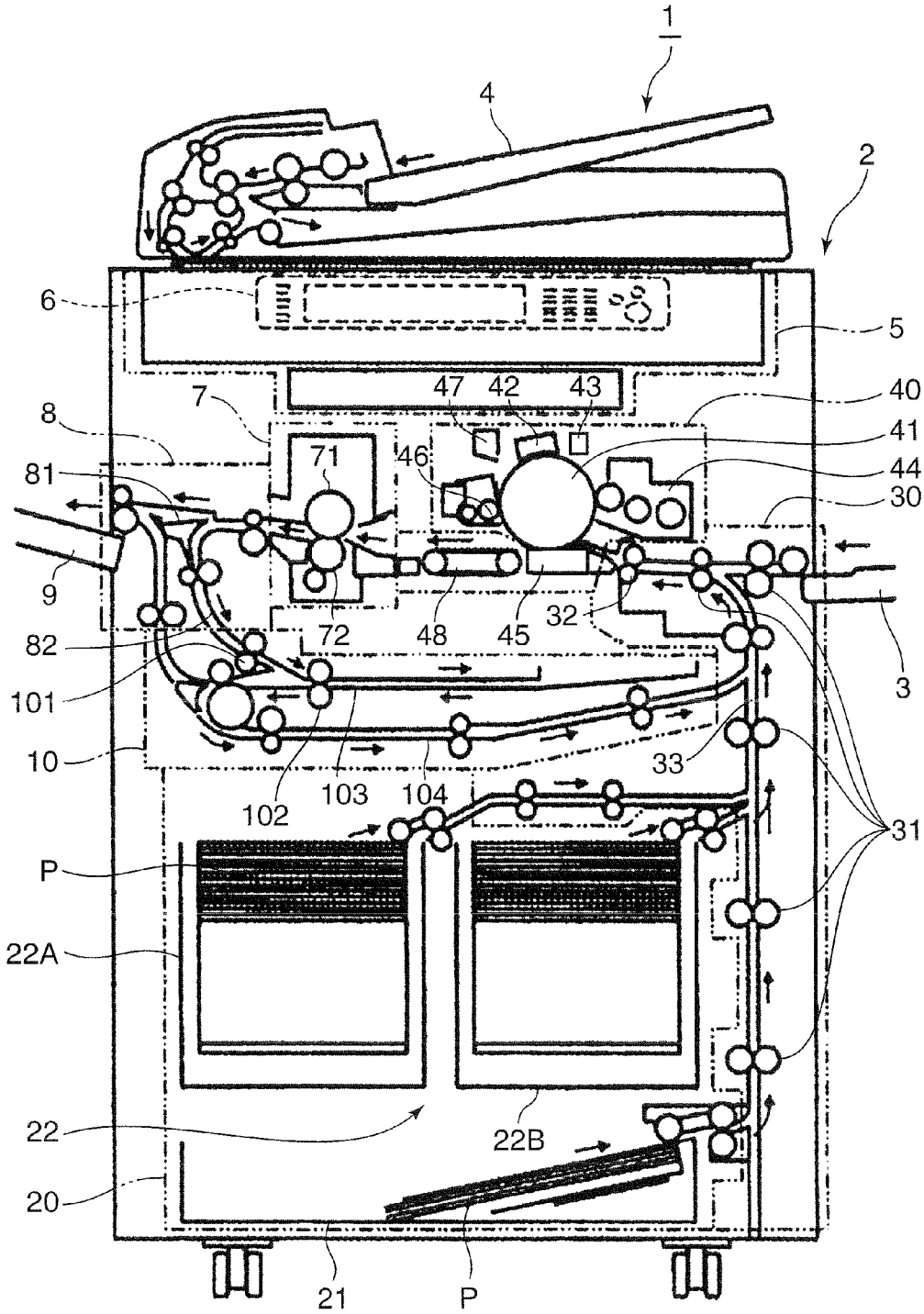
FIG. 1 is a schematic front view in vertical section of an image forming apparatus provided with a sheet width aligning device and a sheet transport device.

FIG. 1 is a schematic front view in vertical section of an image forming apparatus 1 provided with the sheet width aligning device and the sheet transport device according to the present invention. This image forming apparatus 1 is provided with a sheet feeding unit 20, an image forming unit 40 and a fixing unit 7 in a main body 2, a manual sheet feeder 3 on a side surface of the main body 2 and a document feeder 4 on the top surface. Further, for the transportation of a sheet, a vertical transport path 30 is provided upstream of the image forming unit 40 and a branching unit 8 downstream thereof. There is also provided a sheet reversing unit 10 for duplex printing. Solid-line arrows in FIG. 1 indicate sheet transport paths and transport directions.

As shown in FIG. 1, the sheet feeding unit 20 is arranged in a lower part of the main body 2 of the image forming apparatus 1. The sheet feeding unit 20 includes a normal general-purpose sheet cassette 21 and large-capacity sheet cassettes 22. The large-capacity sheet cassettes 22 include an upstream large-capacity sheet cassette 22A and a downstream large-capacity sheet cassette 22B, which are two sheet cassettes of the same capacity horizontally arranged at the same height. Sheets P before being subjected to the printing process are stacked and stored in these sheet cassettes, and are fed one by one by driving a pickup roller and transported to the image forming unit 40 via a feed transport path 33. It should be noted that the number and arrangement of the respective sheet cassettes are not limited to the foregoing structure. A sensor (not shown) for detecting the size of stored sheets P is arranged in each sheet cassette, and returns a data signal on the size of the sheet P in response to a request signal outputted from a controller to be described later.

The manual sheet feeder 3 is provided in an upper part of the right surface of the main body 2. The manual sheet feeder 3 can feed sheets of sizes accommodated in none of the above sheet cassettes and arbitrary printing media such as OHP sheets one by one to the main body 2. A sensor (not shown) for detecting the size of a manually fed sheet is arranged in the manual sheet feeder 3 and returns a data signal on the size of the sheet P in response to a request signal outputted from the controller to be described later. The vertical transport path 30 transports a sheet P fed from the sheet feeding unit 20 or the manual sheet feeder 3 to the image forming unit 40 by a pair of transport rollers 31 and a pair of registration rollers 32.

The document feeder 4 is provided on the top surface of the main body 2 and an image reader 5 is provided below the document feeder 4. An operation panel 6 including a display enabling a user to see an operation screen, an error message and the like and an operation unit used to input various operation commands is provided in front of the document feeder 4. When copying documents, the user places the documents on the document feeder 4 and starts printing by operating the operation panel 6. Images of the documents fed one by one by the document feeder 4 are read, converted into electrical signals and outputted as image data to the image forming unit 40 by the image reader 5.

The image forming unit 40 transfers a toner image onto a sheet P by an electrophotographic process based on the image data outputted from the image reader 5. Specifically, the image forming unit 40 includes a photoconductive drum 41 rotatable about its central axis, a charger 42, an exposing device 43, a developing device 44, a transfer device 45, a cleaner 46 and a charge neutralizer 47 arranged around the photoconductive drum 41 in a rotating direction. The charger 42 is provided for applying a specified potential to the outer surface of the photoconductive drum 41 to uniformly charge the outer surface. The exposing device 43 selectively attenuates the potential of the photoconductive drum 41 by irradiating the photoconductive drum 41 with a laser light based on the image data outputted from the image reader 5, thereby forming an electrostatic latent image on the outer surface of the photoconductive drum 41. The developing device 44 is provided for forming a toner image by supplying toner onto the outer surface of the photoconductive drum 41 having formed thereon an electrostatic latent image. The transfer device 45 is provided for transferring the toner image formed on the photoconductive drum 41 onto the sheet P. The cleaner 46 is provided for removing the residual toner remaining on the outer surface of the photoconductive drum 41, and the charge neutralizer 47 is provided for removing electric charges residual on the outer surface of the photoconductive drum 41. The sheet P having the toner image transferred thereto is transported to the fixing unit 7 by a conveyor belt 48.

The fixing unit 7 is provided for fixing the toner image as transferred onto the sheet P in the image forming unit 40. The fixing unit 7 includes a heating roller 71 having an electric heating element as a heat source inside and a pressure roller 72 arranged to face the heating roller 71. The sheet P transported from the image forming unit 40 has the toner image thereon fixed by the heat of the heating roller 71 while being held between the heating roller 71 and the pressure roller 72.

The branching unit 8 is provided for directing the sheet P having gone through the fixing process to a transport destination and is provided downstream of the fixing unit 7. The sheet P discharged from the fixing unit 7 is discharged to a discharge tray 9 via a switching guide 81 in the branching unit 8 in the case of simplex printing while being transported to the sheet reversing unit 10 via the switching guide 81 in the case of duplex printing. The switching guide 81 is switchable to a position inclined upwardly toward the downstream side, a position inclined downwardly toward the downstream side and an intermediate position therebetween.

The case of duplex printing is described below. The sheet P finished with printing on one side is transported to a reversing transport path 82 by the switching operation of the switching guide 81 and is further transported to a reversing tray 103 via nip portions between a pair of first reversing rollers 101 and between a pair of second reversing rollers 102. When the trailing end of the sheet P passes the pair of first reversing rollers 101, the sheet P is temporarily freed from the nip portion between the pair of second reversing rollers 102 and the width thereof is aligned by a sheet width aligning device of the reversing tray 103. This sheet width aligning device is described in detail later. The sheet P having the width thereof aligned is transported to the feed transport path 33 via the reversing transport path 104 by the rotation of the pair of second reversing rollers 102 in reverse directions while being held in the nip portion between the pair of second reversing rollers 102 again. The sheet P is transported to the feed transport path 33 after being reversed upside down to be subjected to the transfer process again in the image forming unit 40. The sheet P having a toner image transferred thereto is subjected to the fixing process in the fixing unit 7. Thereafter, the sheet P is then discharged to the discharge tray 9 via the switching guide 81.

Figure 2:
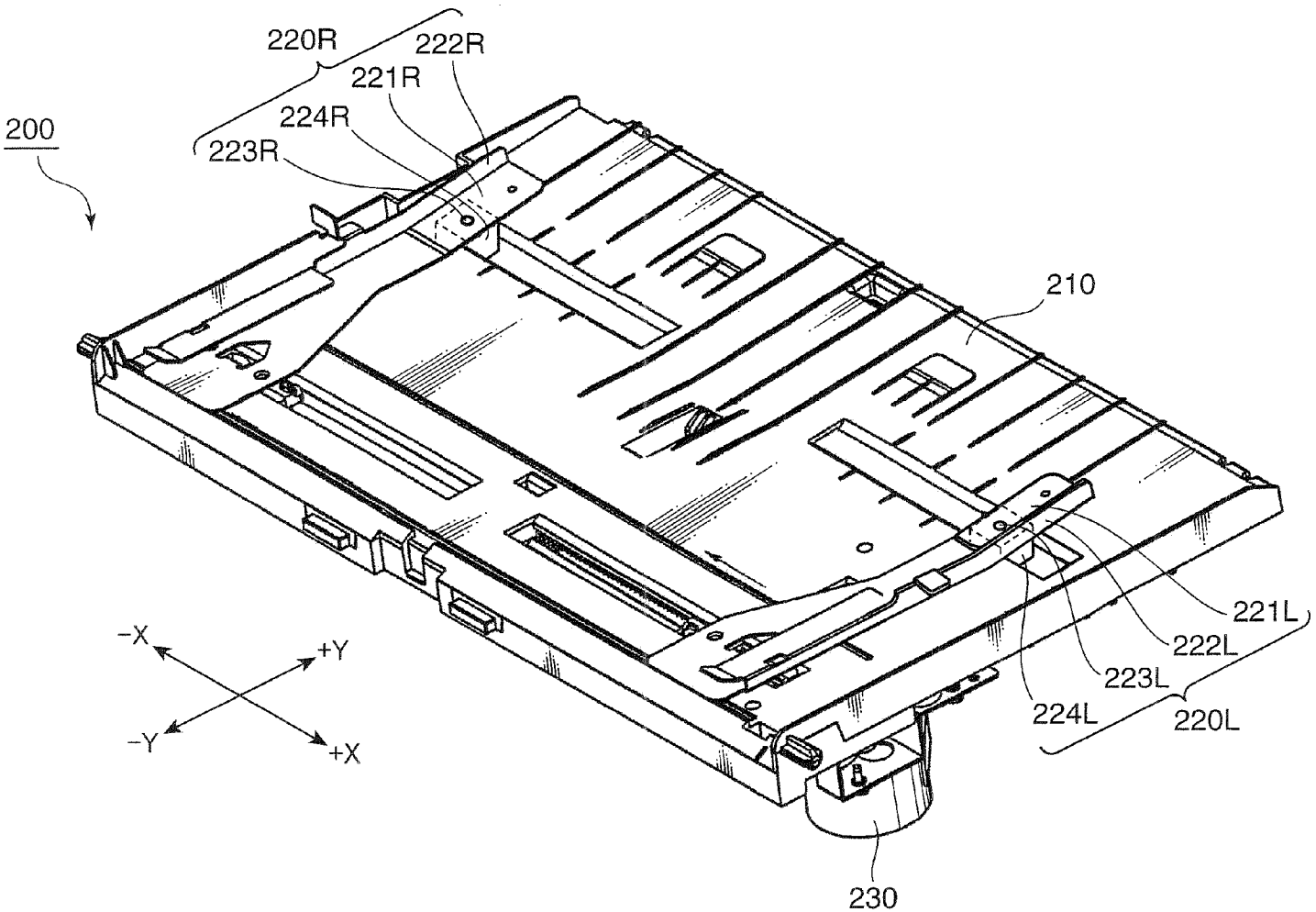
FIG. 2 is a perspective view showing an example of the sheet width aligning device.

In this embodiment, the sheet width aligning device according to the present invention is provided in the reversing tray 103. The sheet transport device according to the present invention corresponds to the respective transport paths constituting the main body 2. FIG. 2 is a perspective view showing an example of a sheet width aligning device 200. In FIG. 2, X-X directions and Y-Y directions respectively indicate transverse directions and forward and backward directions, particularly −X direction being a rightward direction, +X direction a leftward direction, −Y direction a forward direction and +Y direction a backward direction.

The sheet width aligning device 200 includes a pair of cursors 220R, 220L (hereinafter, collectively "cursors 220") arranged in a sheet widthwise direction (transverse direction), a tray 210 supporting the cursors 220, racks (not shown) for moving the cursors 220 and a motor 230 for driving pinions (not shown) in mesh with the racks. The racks and the pinions are for simultaneously moving the pair of cursors 220 in the sheet widthwise directions, but a moving mechanism other than the racks and the pinions may be employed or moving mechanisms may be individually provided for the respective cursors 220.

The cursor 220R is made up of a supporting plate 221R for supporting the right end of the sheet P as transported and a vertical plate 222R standing at a lateral edge of the supporting plate 221R distant from the cursor 220L for regulating the widthwise position of the sheet P and includes an opening 223R formed in the supporting plate 221R and an optical sensor 224R. Similarly, the cursor 220L includes a supporting plate 221L, a vertical plate 222L, an opening 223L and an optical sensor 224L. Here, by arranging the optical sensors 224R, 224L (hereinafter, collectively "optical sensors 224") on the supporting plates 221R, 221L, the cursors 220 and the optical sensors 224 can be moved together by one moving mechanism (racks, pinions and motor 230) to simplify a control and reduce the number of parts. In this way, the cost reduction and miniaturization of the apparatus can be realized.

Each optical sensor 224 is, for example, a reflective optical sensor and includes a light emitting element and a light receiving element. Lights are emitted from the light emitting elements through the openings 223R, 223L. When the sheet P comes to be located above the optical sensors 224, lights emitted from the light emitting elements are reflected by the sheet P and the light receiving elements detect the reflected lights. When the light receiving elements detect the reflected lights, the optical sensors 224 output pulse signals. Although the optical sensors are exemplified as detectors for the sheet P in this embodiment, any sensors may be employed provided that they can be arranged on the cursors 220 and can detect the sheet P.

In the case of duplex printing, the width of the sheet P has been conventionally aligned by driving the motor 230 to move the cursors 220 such that the sheet width based on the size of the sheet P becomes a distance between the vertical plates 222L and 222R. However, in some cases, even sheets of the same size (e.g. sheets treated as those of A4 size) may actually have different widths due to the contraction of sheets caused by a fixing process, size errors and cutting errors of sheets of the respective sheet manufacturers. In the case of applying duplex printing to sheets that are of the same size, but have varying widths, the positions of the sheets cannot be perfectly corrected only by determining the distance between the cursors 220 in accordance with the sheet size to perform width alignment as is conventionally done, which causes the misalignment of printing positions on one and the other sides.

Accordingly, the sheet width aligning device 200 according to the present invention detects the width of the sheet P using the optical sensors 224 and moves the cursors 220 so that the distance between the vertical plates 222R and 222L becomes the detected sheet width and the sheet P is arranged at a position where the printing positions on the one and the other sides coincide (hereinafter, "correct printing position"). By doing so, the misalignment of the printing positions on the one and the other sides can be prevented since width alignment can be performed in conformity with the width of each sheet.

Figure 3:
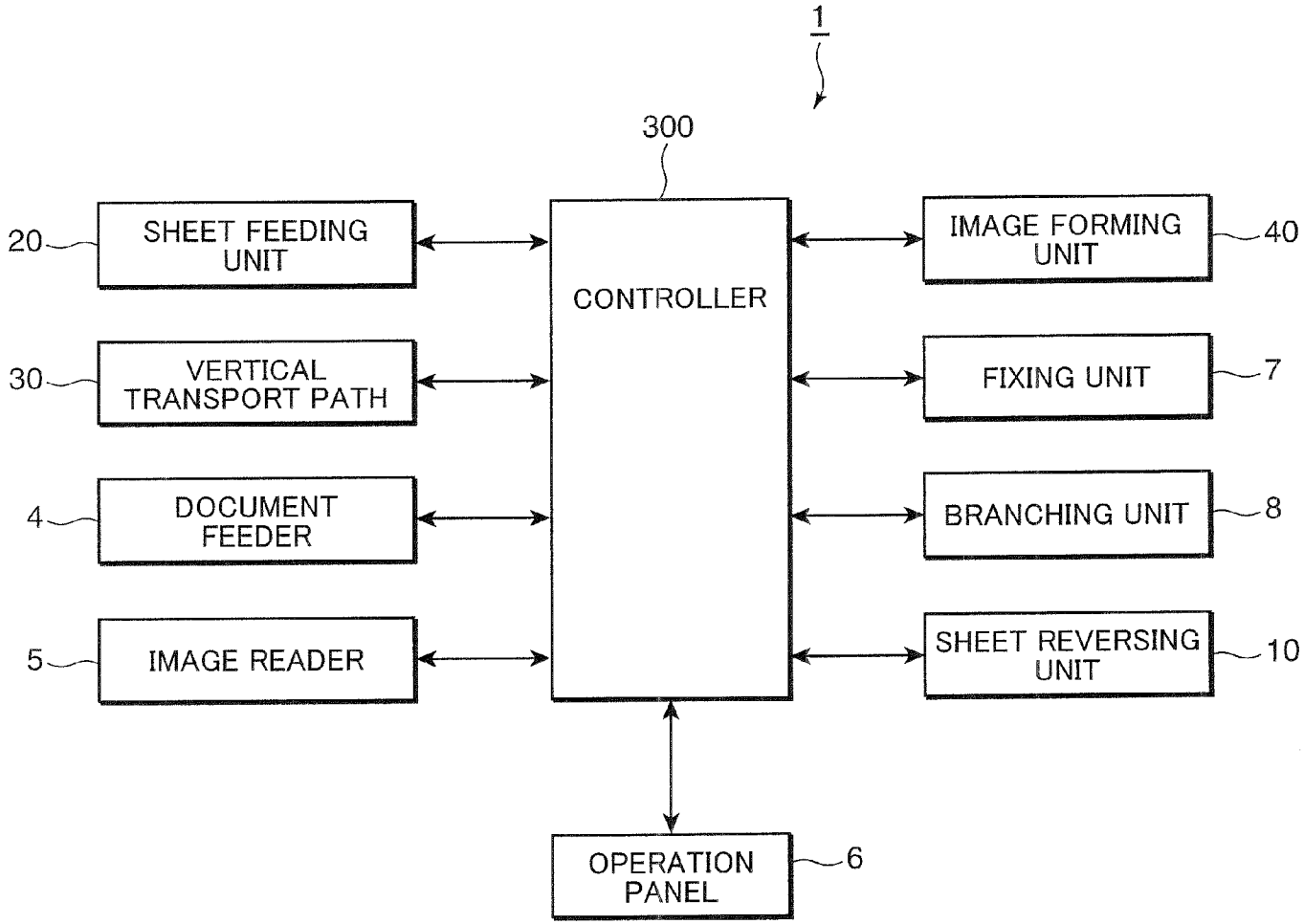
FIG. 3 is a block diagram showing the electrical construction of the image forming apparatus.

A sheet width aligning method is described below. FIG. 3 is a block diagram showing the electrical construction of the image forming apparatus 1 according to this embodiment. The constituent elements described above are not described here by being identified by the same reference numerals. A controller 300 includes a CPU and the like and centrally controls the image forming apparatus 1 by performing processes in accordance with a specified program in response to inputted instruction signals and the like to output instruction signals to the respective functional portions and transfer data and the like. In the case of duplex printing, after a sheet P is transported to the sheet width aligning device 200, the controller 300 moves the cursors 220 to have the optical sensors 224 detect the opposite widthwise ends of the sheet P and calculates the width of the sheet P and a displacement amount between the correct printing position and the sheet P based on detection timings. After moving the cursors 220 based on the calculated sheet width and displacement amount, the controller 300 rotates the pair of second reversing rollers 102 in the reverse directions to transport the sheet P to the feed transport path 33.

Figure 4:
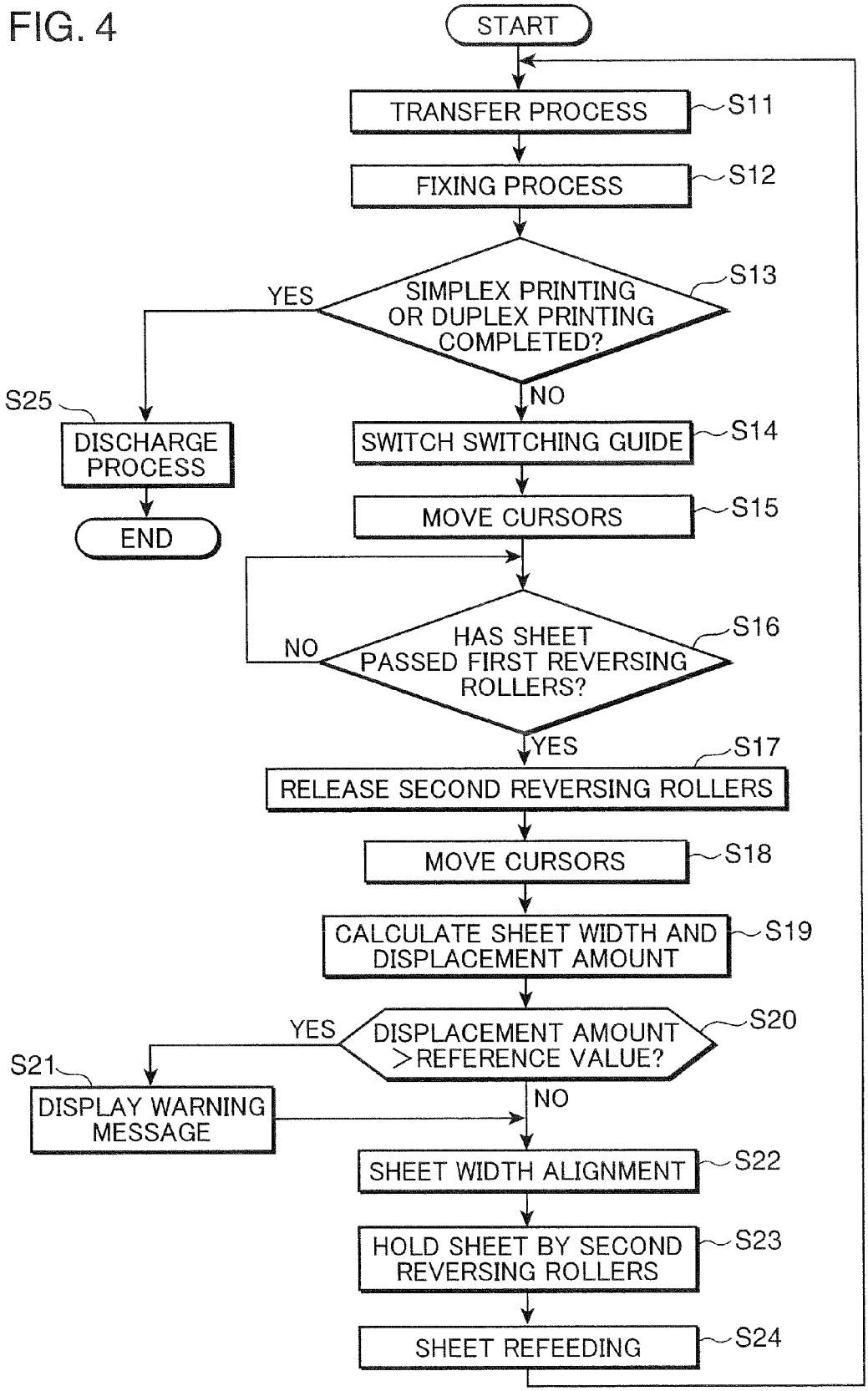
FIG. 4 is a flow chart showing the flow of a sheet width aligning process.
Figure 6:
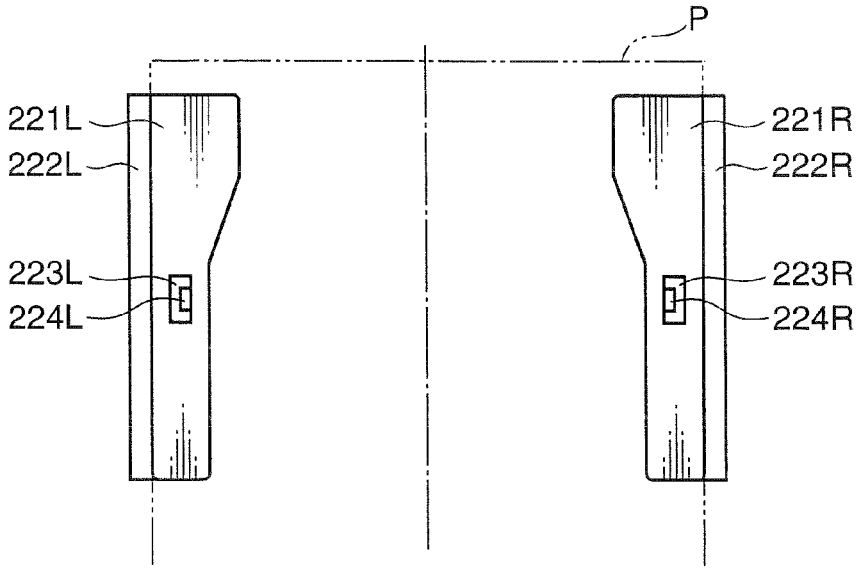
FIG. 6 is a top view showing movements of the cursors.
Figure 7:
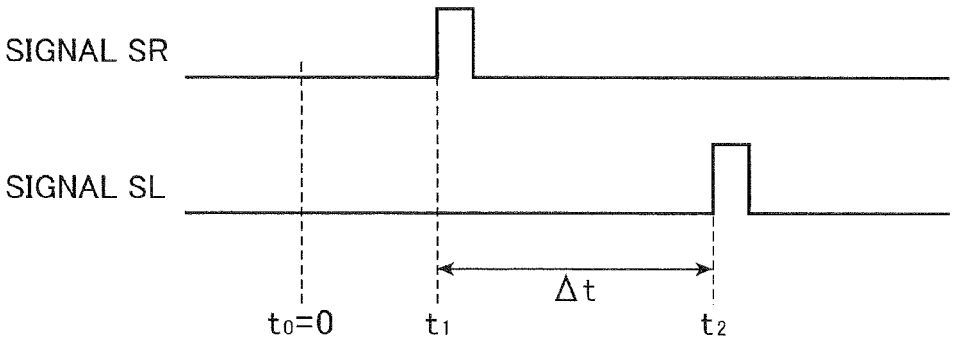
FIG. 7 is a timing chart of signals outputted from an optical sensor.

The aligning method for the sheet P is described in detail with reference to FIGS. 4 to 7. FIG. 4 is a flow chart showing the flow of a sheet aligning process for the sheet P. FIGS. 5 and 6 are top views showing movements of the cursors 220. FIG. 7 is a timing chart of signals to be outputted from the optical sensors 224, wherein a signal SR is an output signal from the optical sensor 224R and a signal SL is the one from the optical sensor 224L. As shown in FIG. 4, after a transfer process (Step S11) and a fixing process (Step S12) are applied to one side of a sheet P by the control of the controller 300, the controller 300 judges whether or not printing this time is simplex printing or printing on the other side of the duplex printing to finish duplex printing (Step S13). If simplex printing or duplex printing has been completed (YES in step S13), the controller 300 switches the switching guide 81 toward the discharge tray 9 to discharge the sheet P (Step S25), thereby completing the printing process.

If only printing on one side of duplex printing has been completed (NO in Step S13), the controller 300 switches the switching guide 81 toward the sheet reversing unit 10 (Step S14). Then, the controller 300 receives a data signal on the size of the sheet P from the sensor (not shown) arranged in the general-purpose sheet cassette 21, the large-capacity sheet cassette 22 or the manual sheet feeder and drives the motor 230 to move the cursors 220 after determining a distance between the optical sensors 224R, 224L based on this data signal (Step S15). For example, if a sheet of A4 size is fed, the cursors are moved to initial positions for A4 size determined beforehand. When the trailing end of the sheet P passes the pair of first reversing rollers 101 (YES in Step S16), a nipping state of the pair of second reversing rollers 102 is canceled (Step S17).

Figure 5A:
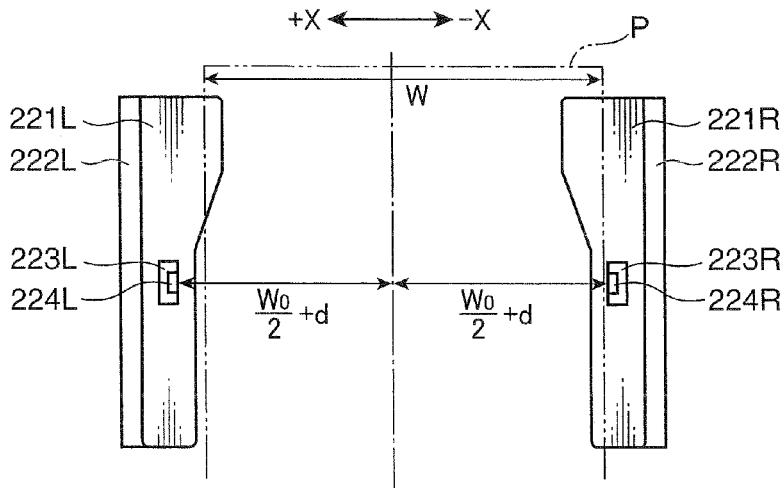
FIGS. 5 are top views showing movements of cursors.

FIG. 5A is a diagram showing an exemplary state of the cursors 220 and the sheet P when Step S17 is completed. A chain double-dashed line in FIG. 5A indicates the sheet P and a dashed dotted line indicates the widthwise center of the correct printing position. It should be noted that direction indications by X are similar to the case of FIG. 2, i.e. X-X directions are transverse directions (−X direction: rightward direction, +X direction: leftward direction).

The controller 300 calculates the distance L between the optical sensors 224L and 224R based on the data signals on the size of the sheet P. For example, the controller 300 sets the distance L to be larger than the width of the sheet P with the correct printing position as a center. Specifically, if W0 denotes the width of the size of the sheet P (e.g. general sheet width of A4 size if the sheet P is A4 size), the distance L between the optical sensors 224R and 224L is set to the sum of the sheet width W0 and 2d (d is a predetermined positive integer) (W0+2d). In other words, $$L=W0+2d \quad (1).$$

Figure 5B:
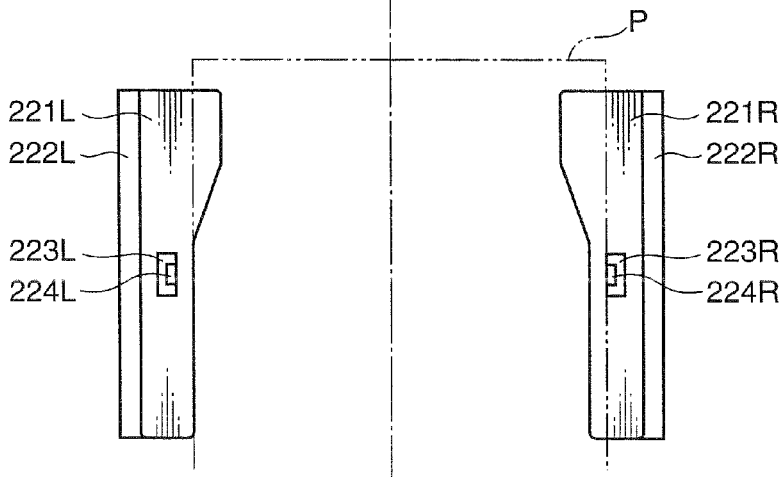

Referring back to FIG. 4, the controller 300 drives the motor 230 to simultaneously move the cursors 220 in directions toward the widthwise center (cursor 220R: leftward direction, cursor 220L: rightward direction) at the same speed (Step S18) and starts the detection of the sheet P by the optical sensors 224. FIG. 5B is a diagram showing a state when the optical sensor 224R detected the right end of the sheet P. Upon detecting the right end of the sheet P, the optical sensor 224R outputs the pulse signal SR as shown in FIG. 7. In FIG. 7, t0 is a movement start timing of the cursors 220 and t1 is a timing at which the pulse signal is outputted from the optical sensor 224R.

Figure 5C:
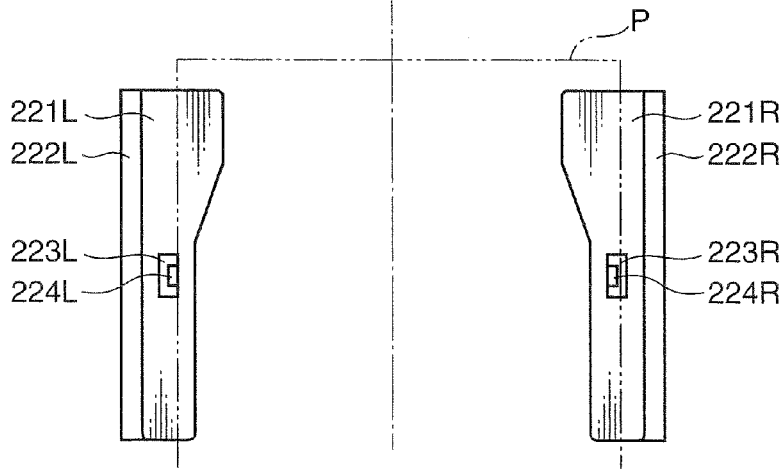

The cursors 220 continue to move toward the widthwise center to reach a state shown in FIG. 5C. FIG. 5C is a diagram showing a state when the optical sensor 224L detected the left end of the sheet P. Upon detecting the left end of the sheet P, the optical sensor 224L outputs the pulse signal SL as shown in FIG. 7. Here, t2 is a timing at which the pulse signal is outputted from the optical sensor 224L.

Referring back to FIG. 4, when both optical sensors 224R and 224L detect the sheet P, the controller 300 calculates the width of the sheet P and a displacement from the correct printing position based on the detection timings of the sheet P by the optical sensors 224R, 224L and a difference in detection timing (Step S19). An exemplary calculation method is described. A displacement amount between the center of the sheet P and that of the correct printing position is in proportion to a difference in detection timing Δt between the detection timings of the sheet P by the optical sensors 224R and 224L. If c, v denote the displacement amount between the center of the sheet P and that of the correct printing position and a moving speed of the cursors 220, $$C=(t2-t1)\times v\times 1/2 \quad (2).$$

The position of the sheet P and the correct printing position coincide if c=0, the sheet P is displaced to the left from the correct printing position if c<0, and the sheet P is displaced to the right from the correct printing position if c>0.

Steps S18, S19 may be performed before Step S17.

Further, the width W of the sheet P is:

$$W=(W0+2d)-(t1\times v+t2\times v) \quad (3).$$

In other words, the sheet width W is a value obtained by subtracting distances the optical sensors 224R, 224L moved until detecting the sheet P from the distance L between the optical sensors 224R and 224L before the movements of the cursors 220.

Referring back to FIG. 4 again, the controller 300 displays a warning message on the display of the operation panel 6 (Step S21) if the displacement amount c is larger than a preset reference value (YES in Step S20). If the displacement amount c is large, a displacement of the set position of sheets P stored in the sheet feeding unit 20 or an occurrence of abnormality in the transport path for the sheet P can be thought. Accordingly, by notifying a warning message to the user according to the displacement amount c, the user can easily know the abnormality of the apparatus and can let images formed at correct positions of the sheet P. The preset reference value may be determined by a designer beforehand prior to shipment from a factory and stored, for example, in a memory of the controller 300 or may be a value arbitrarily settable by the user by means of the operation panel 6 and the like.

Subsequently, the controller 300 drives the motor 230 to move the cursors 220 so that the distance between the vertical plates 222R and 222L becomes the sheet width W calculated in Step S19 (Step S22). Then, the controller 300 causes the pair of second reversing rollers 102 to nip the sheet P (Step S23), rotates the second reversing rollers 102 in the reverse directions to transport the sheet P from the reversing transport path 104 to the feed transport path 33 (Step S24). Thereafter, the controller 300 proceeds to the processing of Step S11.

As described above, the width W of the sheet P is calculated using the detection timings of the sheet P by the optical sensors 224R, 224L and the cursors 220 are moved such that the distance between the vertical plates 222R and 222L becomes the calculated sheet width W and the sheet P is arranged at the position where the printing positions on the one and the other sides coincide (correct printing position), whereby width alignment can be performed in conformity with the actual width of each sheet. Accordingly, the positions of the sheets P can be corrected to correct positions even if sheets of the same size have different widths due to the contraction of sheets caused by the fixing process, size errors and cutting errors of sheets of the respective sheet manufacturers. Therefore, the misalignment of the printing positions on the one and the other sides can be prevented and good print quality can be maintained.

Further, by calculating the displacement amount c between the position of the sheet P and the correct printing position using the difference in detection timing between the detection timings of the sheet P by the optical sensors 224R, 224L and notifying a warning message to the user according to the displacement amount c, apparatus abnormalities such as the displacement of the set position of the sheets P and abnormalities in the transport paths of the sheet P can be known to the user. Therefore, the user can easily know the apparatus abnormalities and can let images formed at correct positions of the sheets P.

The present invention is not limited to the above embodiment and various changes can be made. For example, in the above embodiment, the calculation methods for the displacement amount c between the center of the sheet P and that of the correct printing position and for the sheet width W are described using the equations (1) to (3). However, any other methods may be used provided that they are calculation methods using the detection timings of the sheet P by the optical sensors 224 and the difference in detection timing. Further, although the sheet width aligning device 200 of this embodiment is applied to the reversing tray 103, it may be, for example, applied to post-processing (stapling, punching and the like) for printed sheets.

The above specific embodiment mainly embraces the inventions having the following structures.

A sheet width aligning device according to one aspect of the present invention comprises a pair of width aligning members spaced apart in a widthwise direction for regulating a widthwise position of a sheet by coming into contact with sides of the sheet; a first detector for detecting one widthwise end of the sheet; a second detector for detecting the other widthwise end of the sheet; a moving mechanism for moving the first and second detectors located at initial positions at outer sides of the sheet such that the first and second detectors respectively move from one end side and the other end side toward the center of the sheet in the widthwise directions; a determining section for determining the positions of the width aligning members based on a detection timing, at which the first detector detected the one end, and a detection timing, at which the second detector detected the other end; and a driving mechanism for driving the width aligning members to move to the positions determined by the determining section.

According to the foregoing structure, the determining section calculates a sheet width based on the detection timing, at which the first detector detected the one end, and the detection timing, at which the second detector detected the other end, and the positions of the width aligning members are determined based on this sheet width. Thus, width alignment can be performed in conformity with each sheet even if sheets of the same size have different widths due to the contraction of sheets caused by a fixing process, size errors and cutting errors of sheets of the respective sheet manufacturers. Thus, the printing positions of the sheets can be correctly set, wherefore good print quality can be maintained.

A sheet width aligning device according to another aspect of the present invention comprises a pair of width aligning members spaced apart in a widthwise direction for regulating a widthwise position of a sheet by coming into contact with sides of the sheet; a first detector for detecting one widthwise end of the sheet; a second detector for detecting the other widthwise end of the sheet; a moving mechanism for moving the first and second detectors located at initial positions at outer sides of the sheet such that the first and second detectors respectively move from one end side and the other end side toward the center of the sheet in the widthwise directions; a calculating section for calculating a difference in detection timing between a detection timing, at which the first detector detected the one widthwise end, and a detection timing, at which the second detector detected the other widthwise end; and a notifying section for performing a specified notifying operation based on the difference in detection timing as calculated by the calculating section.

According to the foregoing structure, a displacement between a specified position and the position of the sheet can be detected based on a difference in detection timing between the detection timing, at which the first detector detected the one end, and the detection timing, at which the second detector detected the other end. For example, if the above specified position is a correct position where the sheet should be located, a displacement amount of the sheet position from the correct position can be calculated based on the difference between the respective detection timings. By performing the notifying operation based on this displacement amount, a user can know apparatus abnormalities such as a displacement of the set position of sheets and can let images formed at correct positions of the sheets.

With the foregoing structure, it is preferable that the width aligning members include at least supporting portions for supporting the sheet; that the first detector is arranged on the supporting portion of one of the width aligning members and the second detector is arranged on the other width aligning member; and that the moving mechanism doubles as a driving mechanism; and the first and second detectors are moved by respectively moving the pair of width aligning members in the widthwise directions.

Further, it is preferable that the supporting portions of the width aligning members are formed with openings; and that the first and second detectors are arranged at such positions that the sides of the sheet can be detected through the openings.

According to the foregoing structure, the first and second detectors are respectively arranged on the pair of width aligning members and the moving mechanism doubles as the driving mechanism, whereby the width aligning members and the first and second detectors can be simultaneously moved to simplify a control. Concurrently, the number of parts can be reduced, wherefore the cost reduction and miniaturization of the apparatus can be achieved.

With the foregoing structure, it is preferable that the moving mechanism moves the pair of width aligning members substantially at the same speed.

It is preferable that a sheet size sensor for detecting the sheet size is further provided; and that the moving mechanism moves the first and second detectors to such initial positions as to define a sheet width wider by a specified length than the sheet size detected by the sheet size sensor.

With the foregoing structure, optical sensors each including a light emitting element and a light receiving element may be, for example, used as the first and second detectors.

According to the foregoing structure, the opposite ends of the sheet can be easily detected by using the optical sensors.

A sheet transport device according to another aspect of the present invention comprises a sheet transport path provided with a sheet width aligning device and adapted to transport a sheet, wherein the sheet width aligning device has the foregoing structure.

An image forming apparatus according to still another aspect of the present invention comprises a sheet transport path provided with a sheet width aligning device and adapted to transport a sheet; and an image forming apparatus main body for forming an image on a sheet transported from the sheet transport path, wherein the sheet width aligning device has the foregoing structure.

According to the foregoing structure, the sheet width aligning device provided in the sheet transport device offers the functions and effects of the present invention.

The specific embodiment or example given in the detailed description of the invention is to elucidate the technical contents of the invention and the invention should not be narrowly interpreted by being limited only to the specific example. Various changes can be made within the spirit of the invention and the scope as claimed.

This application is based on Japanese Patent Application No. 2007-198736 filed in Japan Patent Office on Jul. 31, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet width aligning device, comprising:

a sheet size sensor for detecting a specified sheet size;

a pair of width aligning members which respectively come into contact with widthwise ends of a sheet to regulate a widthwise position of the sheet;

a first detector for detecting one widthwise end of the sheet;

a second detector for detecting the other widthwise end of the sheet;

a moving mechanism for moving the first and second detectors to such initial positions at outer sides of the sheet to define a sheet width wider by a specified length than the specified sheet size as detected by said sheet size sensor, the moving mechanism then moving the first and second detectors respectively from one end side and the other end side toward a center of the sheet in widthwise directions;

a determining section for determining the positions of the width aligning members based on a detection timing, at which the first detector detected the one widthwise end, and a detection timing, at which the second detector detected the other widthwise end; and a driving mechanism for driving the width aligning members to move to the positions as determined by said determining section.

2. A sheet width aligning device according to claim 1, wherein:

the width aligning members include at least supporting portions for supporting the sheet;

the first detector is arranged on the supporting portion of one of said width aligning members and the second detector is arranged on the other of said width aligning members; and the moving mechanism also functions as the driving mechanism and moves said first and second detectors by respectively moving the pair of width aligning members in the widthwise directions.

3. A sheet width aligning device according to claim 2, wherein:

the supporting portions of the width aligning members are formed with openings; and the first and second detectors are arranged at such positions that the sides of the sheet can be detected through the openings.

4. A sheet width aligning device according to claim 1, wherein the first and second detectors are optical sensors each including a light emitting element and a light receiving element.

5. A sheet width aligning device according to claim 1, wherein the moving mechanism moves the pair of width aligning members substantially at the same speed.

6. A sheet transport device, comprising a sheet transport path provided with a sheet width aligning device, for transporting a sheet, wherein said sheet width aligning device includes:

a sheet size sensor for detecting a specified sheet size;

first and second width aligning members which respectively come into contact with opposite first and second widthwise ends of a sheet to regulate a widthwise position of the sheet;

a first detector for detecting the first widthwise end of the sheet;

a second detector for detecting the second widthwise end of the sheet;

a moving mechanism for moving the first and second detectors to such initial positions spaced outwardly of the first and second widthwise ends of the sheet such that the first and second detectors initially are spaced from one another wider by a specified length than the specified sheet size as detected by the sheet size sensor, the moving mechanism then causing the first and second detectors respectively to move from the first end side and the second end side toward a center of the sheet in the widthwise directions;

a determining section for determining the positions of the width aligning members based on a detection timing, at which the first detector detected the first widthwise end, and a detection timing, at which the second detector detected the second widthwise end; and a driving mechanism for driving the width aligning members to move to the positions as determined by said determining section.

7. An image forming apparatus, comprising:

a sheet transport path provided with a sheet width aligning device, for transporting a sheet; and an image forming apparatus main body for forming an image on a sheet transported from the sheet transport path, wherein said sheet width aligning device includes:

a sheet size sensor for detecting a specified sheet size;

first and second width aligning members which respectively come into contact with first and second widthwise ends of a sheet to regulate a widthwise position of the sheet;

a first detector for detecting the first widthwise end of the sheet;

a second detector for detecting the second widthwise end of the sheet;

a moving mechanism for moving the first and second detectors to such initial positions spaced outwardly of the first and second widthwise ends of the sheet such that the first and second detectors initially are spaced from one another wider by a specified length than the specified sheet size as detected by the sheet size sensor, the moving mechanism then causing the first and second detectors respectively to move from the first end side and the second end side toward the center of the sheet in the widthwise directions;

a determining section for determining the positions of the width aligning members based on a detection timing, at which the first detector detected the first widthwise end, and a detection timing, at which the second detector detected the second widthwise end; and a driving mechanism for driving the width aligning members to move to the positions as determined by said determining section.

8. A sheet width aligning device, comprising:

a sheet size sensor for detecting a specified sheet size;

a pair of width aligning members which respectively come into contact with widthwise ends of a sheet to regulate a widthwise position of the sheet;

a first detector for detecting one widthwise end of the sheet;

a second detector for detecting the other widthwise end of the sheet;

a moving mechanism for moving the first and second detectors to such initial positions at outer sides of the sheet to define a sheet width wider by a specified length than the specified sheet size as detected by said sheet size sensor, the moving mechanism further moving the first and second detectors respectively from one end side and the other end side toward a center of the sheet in widthwise directions;

a calculating section for calculating a difference in detection timing between a detection timing, at which the first detector detected the one widthwise end, and a detection timing, at which the second detector detected the other widthwise end; and a notifying section for performing a specified warning notifying operation if the difference in detection timing as calculated by said calculating section exceeds a preset reference value.

9. A sheet width aligning device according to claim 8, wherein:

the width aligning members include at least supporting portions for supporting the sheet;

the first detector is arranged on the supporting portion of one of said width aligning members and the second detector is arranged on the other of said width aligning members; and the moving mechanism moves said first and second detectors by respectively moving the pair of width aligning members in the widthwise directions.

10. A sheet width aligning device according to claim 9, wherein:

the supporting portions of the width aligning members are formed with openings; and the first and second detectors are arranged at such positions that the sides of the sheet can be detected through the openings.

11. A sheet width aligning device according to claim 8, wherein said first and second detectors are optical sensors each including a light emitting element and a light receiving element.

12. A sheet width aligning device according to claim 8, wherein the moving mechanism moves the pair of width aligning members substantially at the same speed.

13. A sheet transport device, comprising a sheet transport path provided with a sheet width aligning device, for transporting a sheet, wherein the sheet width aligning device includes:

a sheet size sensor for detecting a specified sheet size;

first and second width aligning members which respectively come into contact with opposite first and second widthwise ends of a sheet to regulate a widthwise position of the sheet;

a first detector for detecting the first widthwise end of the sheet;

a second detector for detecting the second widthwise end of the sheet;

a moving mechanism for moving the first and second detectors to such initial positions spaced outwardly of the first and second widthwise ends of the sheet in widthwise directions such that the first and second detectors initially are spaced from one another wider by a specified length than the specified sheet size as detected by the sheet size sensor, the moving mechanism then causing the first and second detectors respectively to move from the first end side and the second end side toward a center of the sheet in widthwise directions;

a calculating section for calculating a difference in detection timing between a detection timing, at which the first detector detected the first widthwise end, and a detection timing, at which the second detector detected the second widthwise end; and a notifying section for performing a specified warning notifying operation if the difference in detection timing as calculated by said calculating section exceeds a preset reference value.

14. An image forming apparatus, comprising:

a sheet transport path provided with a sheet width aligning device, for transporting a sheet; and an image forming apparatus main body for forming an image on a sheet transported from the sheet transport path, wherein the sheet width aligning device includes:

a sheet size sensor for sensing a specified sheet size;

first and second width aligning members which respectively come into contact with opposite first and second widthwise ends of a sheet to regulate a widthwise position of the sheet;

a first detector for detecting the first widthwise end of the sheet;

a second detector for detecting the second widthwise end of the sheet;

a moving mechanism for moving the first and second detectors to such initial positions spaced outwardly of the first and second widthwise ends of the sheet in widthwise directions such that the first and second detectors initially are spaced from one another wider by a specified length than the specified sheet size as detected by the sheet size sensor, the moving mechanism then causing the first and second detectors respectively to move from the first end side and the second end side toward a center of the sheet in widthwise directions;

a calculating section for calculating a difference in detection timing between a detection timing, at which the first detector detected the first widthwise end, and a detection timing, at which the second detector detected the second widthwise end; and a notifying section for performing a specified warning notifying operation if a difference in detection timing as calculated by said calculating section exceeds a preset reference value.

* * * * *